US007207568B2

(12) United States Patent
France et al.

(10) Patent No.: US 7,207,568 B2
(45) Date of Patent: Apr. 24, 2007

(54) METHOD OF CONDUCTING A RACING SERIES

(75) Inventors: Brian Z. France, Daytona Beach, FL (US); Mike Helton, Ormond Beach, FL (US); Paul Brooks, Longwood, FL (US); David Hoots, Winston-Salem, NC (US); John Darby, Troutman, NC (US); Mark Dyer, Cornelius, NC (US); Todd Armstrong, Huntersville, NC (US); Steve O'Donnell, Lake Mary, FL (US)

(73) Assignee: NASCAR, Inc., Daytona Beach, FL (US)

( * ) Notice: Subject to any disclaimer, the term of this patent is extended or adjusted under 35 U.S.C. 154(b) by 147 days.

(21) Appl. No.: 10/819,553

(22) Filed: Apr. 7, 2004

(65) Prior Publication Data

US 2005/0225033 A1 Oct. 13, 2005

(51) Int. Cl.
*A63F 9/14* (2006.01)

(52) U.S. Cl. ..... 273/445; 273/459

(58) Field of Classification Search ..... 273/440, 273/445, 459; 463/6

See application file for complete search history.

(56) References Cited

U.S. PATENT DOCUMENTS 5,194,843 A 3/1993 Jones et al.
5,398,941 A * 3/1995 Paulson ..... 273/445
6,293,548 B1 * 9/2001 Swyers et al. ..... 273/236
6,380,911 B1 4/2002 Eaton
6,572,112 B1 * 6/2003 Fischer ..... 273/445
6,869,078 B1 * 3/2005 Slowinski ..... 273/445

OTHER PUBLICATIONS

"New NASCAR playoff structure announced". Jan. 20, 2004. [online]. [retrieved on Oct. 19, 2005]. [retrieved from the Internet <URL: http://www.nascar.com/2004/news/headlines/cup/01/20/points_revision/>.*

McCormick, Steve. "NASCAR's New Points System: Into The Great Unknown" [online]. [retrieved on Oct. 19, 2005]. [retieved from the Internet <URL: http://nascar.about.com/cs/resultsstandings/a/pointsunknown.htm>.*

"NASCAR considers 'playoffs' to spice up season" [online]. [retrieved on Oct. 19, 2005]. [retrieved from the Internet <URL: http://www.crash.net/uk/en/news_view.asp?cid=2&nid=83041>.*

Gordon, Jeff. "Point Break" Winter 2003. [online]. [retrieved on Oct. 19, 2005]. [retrieved from the Internet <URL: http://www.gordonline.com/editorials/122903.html>.*

Article: Arnie Frye, "If You Can't Run with the Big Dogs, Stay Off the Porch", Sep. 19, 2003, 3 pages.

Article: J. Troiano et al. "Hooters Pro Cup Champ Decided in a Different Way", Unknown Date, 4 pgs.

* cited by examiner

*Primary Examiner*—Raleigh W. Chiu
(74) *Attorney, Agent, or Firm*—Michael L. Leetzow, P.A.

(57) ABSTRACT

A method of conducting a racing series for competitors and team owners is disclosed. The racing series has a plurality of races divided into a first and second set of races with competitors racing in both sets of races. The competitors and team owners are awarded points after each race, with those points being adjusted between the two sets of races. The points of only a predetermined number of competitors and/or team owners are adjusted between the sets of races. Awards, including a championship, is awarded based on the points accumulated during the racing series.

18 Claims, 2 Drawing Sheets

METHOD OF CONDUCTING A RACING SERIES

The present invention relates to a method of conducting a racing series for competitors and team owners, and more particularly, a method of conducting a racing series wherein points awarded to the competitors and team owners are adjusted during the racing series.

There are several prior methods for conducting a racing series. However, some of those methods prevent all of the teams in the racing series from participating in all of the races through the championship or the prior art methods require that complicated formulas and starting positions be used. Other prior art methods are only directed at determining a winner for a single race and not for a series of racing events.

Accordingly, the present invention is directed to a new and novel method for conducting a racing series without one or more of the limitations of the prior art. Additional features and advantages of the invention will be set forth in the description that follows, and in part will be apparent from the description, or may be learned by practice of the invention. The objectives and other advantages of the invention will be realized and attained by the process particularly pointed out in the written description and claims, as well as the appended drawings.

SUMMARY OF THE INVENTION

To achieve these and other advantages and in accordance with the purpose of the invention as embodied and broadly described herein, the invention is directed to a method of conducting a racing series with a plurality of competitors, the method includes conducting a plurality of races for the plurality of competitors, the plurality of races comprising a first plurality of races and a second plurality of races, the first plurality of races occurring before and being greater in number than the second plurality of races, awarding points to each of the competitors based on results of each of the first plurality of races, the points accumulating during the racing series for each competitor, adjusting the accumulated points awarded to each competitor after the last race in the first plurality of races to a predetermined number of championship points for each competitor, awarding points to each of the competitors based on the results of each of the second plurality of races, the points awarded during the second plurality of races being added the predetermined number of championship points for each of the plurality of competitors for a championship point total, and awarding prizes to each of the plurality of competitors based on the championship point totals for each competitors.

In another aspect, the invention is directed to a method for determining a champion of a racing series that includes conducting a plurality of races for a plurality of competitors, the plurality of races comprising a first plurality of races and a second plurality of races, the first plurality of races occurring before and being greater in number than the second plurality of races, awarding points to each of the competitors based on results of each of the first plurality of races, the points accumulating during the racing series for each competitor, adjusting the accumulated points awarded to each team after the last race in the first plurality of races to a predetermined number of championship points for each competitor, awarding points to each of the competitors based on the results of each of the second plurality of races, the points awarded during the second plurality of races being added to the predetermined number of championship points for each of the plurality of competitors for a championship point total, and declaring as the champion the competitor having the most championship points.

In yet another aspect, the present invention is directed to a method of conducting a racing series that includes conducting a plurality of races for a plurality of competitors, the plurality of races comprising a first plurality of races and a second plurality of races, the first plurality of races occurring before and being greater in number than the second plurality of races and each of the plurality of competitors having a team owner, awarding team owner points to each of the team owners based on results of a competitor entered in each of the first plurality of races by the team owner, the team owner points accumulating during the racing series for each of the team owners, adjusting the accumulated team owner points to each team owner after the last race in the first plurality of races to a predetermined number of championship team owner points for each team owner, awarding team owner points to each of the team owners based on the results of the second plurality of races, the team owner points awarded during the second plurality of races to each of the team owners being added to the predetermined number of championship owner points for each of the team owners for a championship team owner point total, and awarding prizes to each of the team owners based on the championship owner point totals for each of the team owners.

It is to be understood that the foregoing general description and the following detailed description are exemplary and explanatory and are intended to provide further explanation of the invention as claimed.

The accompanying drawings are included to provide a further understanding of the invention and are incorporated in and constitute a part of the specification. The drawings illustrate several embodiments of the invention and together with the description serve to explain the principles of the invention.

DETAILED DESCRIPTION OF THE INVENTION

Figure 1:
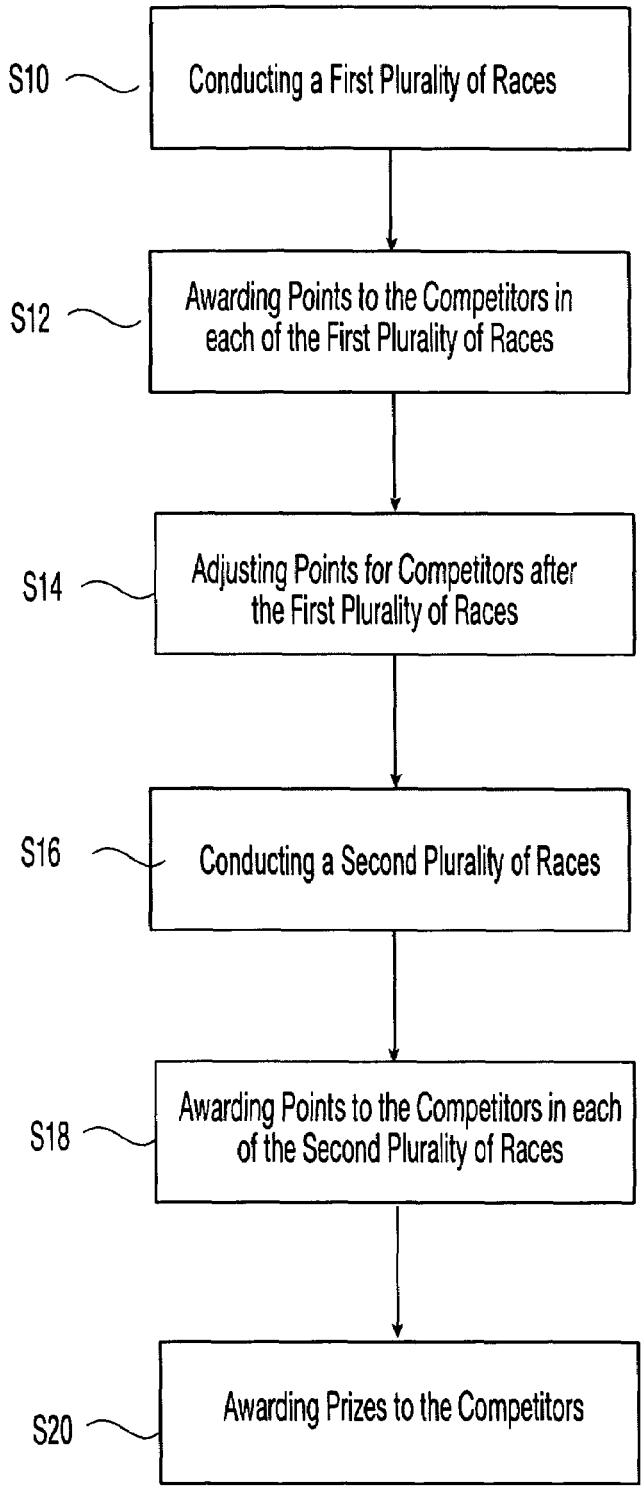
FIG. 1 is a flow diagram illustrating a method of conducting a racing series according to one embodiment of the present invention.

FIG. 1 illustrates a method of conducting a racing series with a number of competitors. The racing series is preferably divided into two sections, a first section with a first plurality of races and a second section with a second plurality of races. In the preferred embodiment, the racing series has thirty-six total races, with twenty-six races in the first set of races and ten races in the second set of races. However, any total number of races and any number of races in the first and second set of races may be run and still be within the scope of the present invention. However, it is preferable that the second set of races have fewer races than the first set of races, although it is not required. It should also be noted that the races may be of any length and/or duration and be within the scope of the present invention. There may also be any number of competitors that race in the racing series. Furthermore, the competitors may race in each of the races in the racing series or the competitors may only race in a specified number of races, including the races in the second set of races.

The racing series and races are preferably conducted for cars and/or trucks. However, the present invention is directed to a racing series for any vehicle, animal, machine or other movable object that may be used for racing. Thus, it is possible to conduct a racing series according to the present invention for stock cars, trucks, open wheel cars (i.e., Indy style cars), boats, riding lawn mowers, animals, etc. As used herein, the term competitor means the person or animal responsible for participating in the race. For example, a driver would be the competitor for cars, trucks, boats and the like. The competitor would be the animal itself when animals are racing in the racing series. It is also preferable that each of the competitors use the same movable object in the races and that there be rules associated with the racing within the races, particularly in the type, manner, size, and construction (if applicable) of the movable objects racing in the racing series. It is also contemplated that the racing series be conducted on a race track (or tracks) or race course(s) of any type or construction. Thus, the competitors will be racing to complete laps around such race track(s) or race course(s). In the event the racing series is run on an alternative surface or in an alternative format (i.e., from point A to point B along a path where A and B are different locations, such as New York to Los Angeles), the races may be divided into distances or segments rather than laps as in the track races. The term lap used herein will mean either or both if the racing series uses both formats.

As illustrated in FIG. 1 at step S10, a first plurality of races is conducted. The competitors earn points based on how well the competitor performs during each race in the plurality of races. In the preferred embodiment, the competitor earns points for the position in which it finishes each race as shown in Table 1 below. See step S12. However, other point values for each position and point differences between the positions could also be used.

TABLE 1

| Points Awarded For Each Race | |
|---|---|
| Position | Points |
| 1 | 180 |
| 2 | 170 |
| 3 | 165 |
| 4 | 160 |
| 5 | 155 |
| 6 | 150 |
| 7 | 146 |
| 8 | 142 |
| 9 | 138 |
| 10 | 134 |
| 11 | 130 |
| 12 | 127 |
| 13 | 124 |
| 14 | 121 |
| 15 | 118 |
| 16 | 115 |
| 17 | 112 |
| 18 | 109 |
| 19 | 106 |
| 20 | 103 |
| 21 | 100 |
| 22 | 97 |
| 23 | 94 |
| 24 | 91 |
| 25 | 88 |
| 26 | 85 |
| 27 | 82 |
| 28 | 79 |
| 29 | 76 |
| 30 | 73 |
| 31 | 70 |

TABLE 1-continued

| Points Awarded For Each Race | |
|---|---|
| Position | Points |
| 32 | 67 |
| 33 | 64 |
| 34 | 61 |
| 35 | 58 |
| 36 | 55 |
| 37 | 52 |
| 38 | 49 |
| 39 | 46 |
| 40 | 43 |
| 41 | 40 |
| 42 | 37 |
| 43 | 34 |

The competitors may also earn points for other events or achievements. For example, a competitor could earn points for leading a lap, for leading the most laps in a race in the racing series, winning the pole position in qualifying, qualifying position, etc. For example, a competitor may earn five points for leading at least one lap and another five points for leading the most laps during the race. Therefore, according to Table 1, the most points a competitor could earn during a race is 190 points (180 points for winning the race, 5 points for leading a lap, and 5 points for leading the most laps). The points are accumulated during the racing series and points earned during a particular race are totaled with the points earned in the previous races.

Since it is possible for owners to have more than one vehicle, animal, etc. in the racing series, the points are to follow the competitor (driver of the vehicle or the entrant in the case of animals). A method for awarding points to owners is discussed in detail below. In the case of a vehicle racing series, for example, if Driver1 fails to drive in a particular race, Driver1 would not earn any points. If another driver (Driver2) drives Driver1's car, then Driver2 would earn those points and they would go to Driver2's point total. Similarly, if Driver1 drives a different vehicle than in previous races, then Driver1 would still earn points that would be added to the total points Driver1 previously accumulated. However, in one embodiment, a driver may earn points in a race for only for the first vehicle in which the driver competed. For example, if Driver1 becomes ill and Driver2 had a problem with his/her vehicle during the race that prevented Driver2 from continuing in the original vehicle, Driver2 could relieve Driver1 in Driver1's vehicle. While the team owner would continue to earn points based on Driver2's performance, Driver2 would not earn any points in Driver1's vehicle. Driver2 would be able to retain any points earned in Driver2's own vehicle. In an alternative embodiment, Driver1 could receive any points that are "earned" by Driver2 while Driver2 is driving Driver1's vehicle.

After all of the races in the first set of races has been run, the points accumulated by all of the competitors (drivers/entrants) are then adjusted for the second set of races. See step S14. All competitors (drivers/entrants) are eligible to participate in the second set of races, even if they have not competed in the first set of races. However, in the preferred embodiment of the present invention, only a select number of competitors (drivers/entrants) have their point totals adjusted to a new championship point total. In that preferred embodiment, only the top ten competitors (drivers/entrants)

have their point totals adjusted. One example of the adjustment of the points to the new championship point total is illustrated below in Table 2.

TABLE 2

Adjusted Point Totals

| Position after 26 Races | Adjusted Point Total |
|---|---|
| 1 | 5050 |
| 2 | 5045 |
| 3 | 5040 |
| 4 | 5035 |
| 5 | 5030 |
| 6 | 5025 |
| 7 | 5020 |
| 8 | 5015 |
| 9 | 5010 |
| 10 | 5005 |
| Within 400 points | 5000 |

In the embodiment illustrated in Table 2, the top ten competitors will have their point totals adjusted. The points are to be adjusted to 5050 for the leading competitor and then the points for each position decreases by 5 points. The point totals for the remainder of the competitors in the racing series are not adjusted, but remain the same. It should be noted that the adjusted point totals could be different in value and in number of points separating each position.

The present invention also contemplates allowing additional competitors to have their point totals adjusted even if the competitors finish the first set of races lower than the predetermined finishing position. For example, if there are competitors that have point totals within a certain number of points of the leading competitor (400 points, for example), but are not within the top 10, then those competitors may also have their point total adjusted. As shown in Table 2, those competitors within 400 points of the leader would also have their point totals adjusted to 5000 points. In this embodiment, there may be multiple competitors with point totals within the predetermined number of points of the leading competitor. Thus, there may be more than one competitor with an adjusted point total (championship point total) of 5000 points, provided the competitors were within 400 points of the leading competitor.

In another embodiment, it is also contemplated that the adjusted point totals for those within 400 points of the leading competitor may also continue to decrease by five points (or any other point value) for each position after the top 10 positions so that no competitors have the same number of adjusted points. For example, if there were two competitors outside the top ten competitors, but one competitor was within 395 points of the leader and the other competitor within 398 points, those two competitors would be awarded 5000 and 4995 points, respectively. While a value of 400 points has been specified, any value could be used and fall within the scope of the present invention.

In another embodiment, the racing series could determine the additional competitors who have their point totals adjusted in another manner. For example, there could be a single race event where a predetermined number of competitors (e.g. the first or first two finishers) have their point totals adjusted to 5000 points as with those within 400 points as illustrated above. There are other criteria that could also be used. For example, any driver who won more than two racing events, any driver who has moved more than 10 places in the point total standings in the first set of races, etc.

The competitors that are not in the top ten and are not one of the additional competitors (i.e., within a certain point value that is identified to the competitors or based on other criteria) do not have their point totals adjusted. However, the present invention allows all competitors to continue to participate in the remaining events that some other prior art systems do not.

Then, according to step S16, a second plurality of races is conducted. The competitors continue to accumulate points in the second set of races as they did in the first set of races. See step S18. However, the points earned in the second set of races are then added to the new adjusted point totals (or the accumulated point totals for those whose points were not adjusted) and the point totals from the first set of races is disregarded for those competitors whose point totals were adjusted. After the conclusion of the last race in the second set of races (and the racing series itself), the competitor with the most championship points is declared the racing series winner. See step S20. The other competitors may also be awarded prizes on the basis of their final championship point total as well. The prizes may include monetary awards, trophies, merchandise, etc. and/or a combination of these awards.

Figure 2:
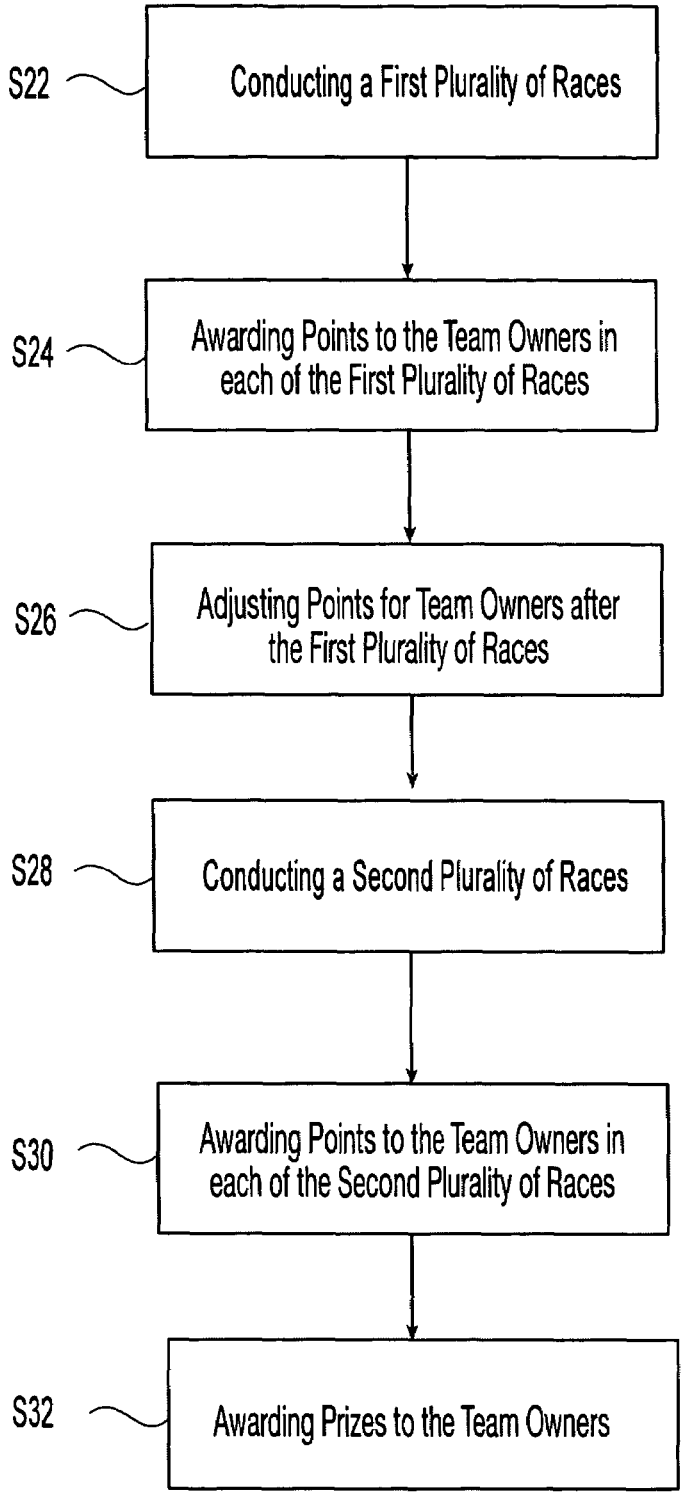
FIG. 2 is a flow diagram illustrating a method of conducting a racing series according to a second embodiment of the present invention.

The present invention also contemplates having a championship series among the team owners. Team owners may have more than one competitor participating in the racing series. In order to foster the spirit of competition and excitement, the team owners will similarly acquire points during the racing series as illustrated in FIG. 2. The team owners will acquire points for the performance of a particular vehicle (independent of the driver) or entrant. For example, if the team owner has two competitors, the owner will receive points for each vehicle/entrant respectively, independent of the driver of the car, truck, etc. So, if the driver of the vehicle changes at any time during the racing series, the owners are not at a disadvantage.

Team owner points are awarded in a similar manner to the competitor points described above. As more specifically illustrated in FIG. 2 at step S22, a first plurality of races is conducted. The team owners accumulate points during each of the set of races as shown in step S24. The team owners will receive points for the order of finish of the competitors as depicted in Table 1 above. In addition, the team owners may be awarded other points, such as points for those competitors/entrants that do not make the starting field in a particular race. It is contemplated that there may be more competitors that want to enter the starting field of a particular race than there are positions in the race. (Many factors dictate the size of a starting field in any particular race, including the size and length of the race track, the number and size of pits, the size of the infield and garage area, etc.) In order to narrow the field, the competitors may have to qualify to enter the race. For example, the starting field may, as indicated in Table 1, be limited to forty-three competitors. While the fastest forty-three competitors may be allowed to enter the race, the present invention is not so limited. The competitors may be allowed to enter the starting field under a number of scenarios. For example, the competitors may have a number of exemptions from qualifying during the racing series and may use the exemption to enter the race rather than having to qualify. The manner in which the competitors are entered into the field is beyond the scope of the present invention. Additionally, the competitors and/or their vehicles may have to pass inspection to ensure that the team meets all of the rules and regulations required to enter the race. Again, the details of such rules and regulations are beyond the scope of the present invention. However, points may be awarded to the team owners based upon the qualifying attempts and inspections. As a result, there will be more opportunities for the team owners to be awarded team owner points even if the competitor and/or the vehicle/entrant does not qualify for a particular race.

In one embodiment of the present invention, the team owners are awarded points based on passing inspection, but failing to qualify to enter the race. In this circumstance, there are more competitors attempting to qualify than there are positions in the starting field. Points are awarded to the team owners based on where competitors placed during qualifying (even if they do not make the starting field), and the points awarded to the team owners are the same as those in Table 1. If there are more than forty-three competitors, then the points awarded by position, subtracting three points for each position below those listed in Table 1. For example, if the race field is limited to forty-three competitors and forty-six competitors attempt to qualify, the team owner of the competitor qualifying forty-fifth (and thus not a part of the starting field) would receive twenty-eight points. (The competitor would not receive any points since they did not qualify and did not participate in the race). Similarly, if the competitor passes inspection, but for some reason cannot even attempt qualifying, that team owner would receive team owner points corresponding to the position behind those teams who do attempt to qualify. In the above example of forty-six competitors for forty-three starting positions, the team owner whose competitor did not attempt to qualify (but passed inspection) would receive twenty-five points for forty-sixth position assuming all other teams attempted qualifying.

If circumstances prevent all competitors from attempting to qualify for a particular race event, then the team owners are awarded points based on their qualifying position under the rules for the race or the series, again assuming that the competitors passed inspection. Again, the points would only be awarded to those competitors not making the starting field since those team owners making the starting field are awarded owner points at the end of the race. In one preferred embodiment, if the competitors cannot qualify, then they are deemed to have qualified based on the team owner's point totals accumulated up to that event in the racing series. The team owner points given for failing to qualify only become an issue if there are more competitors than positions in the starting field.

Then, as shown in step S26, the team owners also have their point totals adjusted, in a manner similar to the competitors above. That is, the top ten team owners will have their point totals adjusted according the values shown in Table 2 to a new championship point total. However, it is possible to adjust the owner point totals to a different number or even with a different point value separating each of the positions. Similarly, fewer or more team owners could have their point totals adjusted and fall within the scope of the present invention.

A second plurality of races is then conducted as shown in step S28, where the team owners accumulate points as in the first plurality of races. See step S30. At the conclusion of the second plurality of races, a team owner champion is determined by the team owner that has accumulated the most championship points. See step S32. Prizes may also be available for a number of positions and not just the winning team owner. As with the competitors, there may be monetary awards, trophies, merchandise, etc. and/ or a combination of these prizes.

Finally, for both the competitor points and the team owner points, the present invention also is directed to making awards in the event that two competitors or team owners have the same number of points, i.e., a tie. If, at the end of the first or the second set of races, two races teams or team owners have the same number of points, the competitors or team owners will be ranked (given a unique place in the standings) based on the number of first place finishes in the racing series. Therefore, the competitor or team owner that has the most first place finishes will be placed above the other competitors or team owners with fewer first place finishes. If there are still ties among the competitors or the team owners after comparing the first place finishes, the ties will be broken by comparing the number of second place finishes, then third place finishes, etc., until the tie is broken. If, after comparing all finishes, there is still a tie, then the competitor or team owner with the best finish first in the racing series will be placed higher in the standings.

It will be apparent to those skilled in the art that various modifications and variations can be made in the method of conducting a racing series according to the present invention without departing from the spirit or scope of the invention. Thus, it is intended that the present invention cover the modifications and variations of this invention provided they come within the scope of the appended claims and their equivalents.

We claim:

1. A method of conducting a racing series with a plurality of competitors, the method comprising the steps of:

conducting a plurality of races for the plurality of competitors, the plurality of races comprising a first plurality of races and a second plurality of races, the first plurality of races occurring before and being greater in number than the second plurality of races, awarding points to each of the competitors based on results of each of the first plurality of races, the points accumulating during the racing series for each competitor;

adjusting the accumulated points after the last race in the first plurality of races to a predetermined number of championship points for each competitor, the accumulated points being adjusted for only a predetermined number of competitors;

awarding points to each of the competitors based on the results of each of the second plurality of races, the points awarded during the second plurality of races being added to the predetermined number of championship points for each of the plurality of competitors for a championship point total; and awarding prizes to each of the plurality of competitors based on the championship point totals for each competitor.

2. The method of conducting a racing series according to claim 1, wherein the predetermined number of championship points for each competitor is based upon a total number of points earned by the competitor during the first plurality of races.

3. The method of conducting a racing series according to claim 1, wherein the predetermined number of championship points is larger than the points accumulated by any competitor in the first plurality of races.

4. The method of conducting a racing series according to claim 1, wherein the predetermined number of competitors having accumulated points adjusted is ten.

5. The method of conducting a racing series according to claim 1, wherein the predetermined number of competitors having accumulated points adjusted is ten and includes any competitor within a predetermined number of accumulated points of a competitor having the most accumulated points.

6. The method of conducting a racing series according to claim 5, wherein the predetermined number of accumulated points is 400.

7. The method of conducting a racing series according to claim 1, wherein the first plurality of races comprises 26 races.

8. The method of conducting a racing series according to claim 1, wherein the second plurality of races comprises 10 races.

9. The method of conducting a racing series according to claim 1, wherein points awarded to each of the competitors for each of the plurality of races includes points awarded for at least one of leading at least one lap of a race, leading the most laps in a race, and finishing position in a race.

10. The method of conducting a racing series according to claim 1, wherein the prizes includes a championship title.

11. The method of conducting a racing series according to claim 1, wherein the competitors have team owners and further comprising the steps of:

awarding team owner points to each of the team owners based on results of a competitor entered in each of the first plurality of races by the team owner, the team owner points accumulating during the racing series for each of the team owners;

adjusting the accumulated team owner points to each team owner after the last race in the first plurality of races to a predetermined number of championship team owner points for each team owner;

awarding team owner points to each of the team owners based on the results of the second plurality of races, the team owner points awarded during the second plurality of races to each of the team owners being added to the predetermined number of championship owner points for each of the team owners for a championship team owner point total; and awarding prizes to each of the team owners based on the championship owner championship point totals for each of the team owners.

12. The method of conducting a racing series according to claim 11, wherein the predetermined number of championship team owner points for each team owner is based upon a total number of points awarded to the team owner during the first plurality of races.

13. The method of conducting a racing series according to claim 11, wherein the predetermined number of championship team owner points is larger than the team owner points accumulated by any team owner in the first plurality of races.

14. The method of conducting a racing series according to 11, wherein the accumulated team owner points for a only predetermined number of team owners is adjusted.

15. The method of conducting a racing series according to claim 14, wherein the predetermined number of team owners having accumulated team owner points adjusted is ten.

16. The method of conducting a racing series according to claim 11, wherein team owner points awarded to each of the team owners for each competitor entered in the plurality of races includes team owner points awarded for at least one of passing an inspection, qualifying position in the race, starting position in the race, leading at least one lap of a race, leading the most laps in a race, and finishing position in a race.

17. A method of conducting a racing series comprising the steps of:

conducting a plurality of races for a plurality of competitors, the plurality of races comprising a first plurality of races and a second plurality of races, the first plurality of races occurring before and being greater in number than the second plurality of races and each of the plurality of competitors having a team owner;

awarding team owner points to each of the team owners based on results of a competitor entered in each of the first plurality of races by the team owner, the team owner points accumulating during the racing series for each of the team owners;

adjusting the accumulated team owner points to each team owner after the last race in the first plurality of races to a predetermined number of championship team owner points for each team owner;

awarding team owner points to each of the team owners based on the results of the second plurality of races, the team owner points awarded during the second plurality of races to each of the team owners being added to the predetermined number of championship owner points for each of the team owners for a championship team owner point total; and awarding prizes to each of the team owners based on the championship owner point totals for each of the team owners.

18. A method of conducting a racing series with a single plurality of competitors, the method comprising the steps of:

conducting a plurality of races for the single plurality of competitors, the plurality of races consisting of a first plurality of races and a second plurality of races for the single plurality of competitors, the first plurality of races occurring before and being greater in number than the second plurality of races;

awarding points to each of the competitors based on results of each of the first plurality of races, the points accumulating during the racing series for each competitor;

adjusting the accumulated points awarded to each competitor after the last race in the first plurality of races to a predetermined number of championship points for each competitor;

allowing each of the competitors in the single plurality of competitors to compete in the second plurality of races regardless of the number of points accumulated by the competitor;

awarding points to each of the competitors based on the results of each of the second plurality of races, the points awarded during the second plurality of races being added the predetermined number of championship points for each of the plurality of competitors for a championship point total; and awarding prizes to each competitor based on the championship point totals for each competitor.

* * * * *